US009930951B2

(12) United States Patent
Nagao

(10) Patent No.: US 9,930,951 B2
(45) Date of Patent: Apr. 3, 2018

(54) DRAWING APPARATUS AND DRAWING METHOD FOR DRAWING APPARATUS

(71) Applicant: CASIO COMPUTER CO., LTD., Shibuya-ku, Tokyo (JP)

(72) Inventor: Tomoyuki Nagao, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/387,288

(22) Filed: Dec. 21, 2016

(65) Prior Publication Data

US 2017/0172279 A1 Jun. 22, 2017

(30) Foreign Application Priority Data

Dec. 22, 2015 (JP) ..... 2015-249224

(51) Int. Cl.

*G06K 15/00* (2006.01)
*A45D 29/00* (2006.01)
*A45D 34/04* (2006.01)
*A45D 44/00* (2006.01)

(52) U.S. Cl.

CPC ..... *A45D 29/00* (2013.01); *A45D 34/04* (2013.01); *A45D 2029/005* (2013.01); *A45D 2044/007* (2013.01)

(58) Field of Classification Search

None

See application file for complete search history.

(56) References Cited

U.S. PATENT DOCUMENTS 6,286,517 B1 * 9/2001 Weber ..... A45D 29/00 132/200
8,814,289 B2 8/2014 Yamasaki
2012/0274683 A1 * 11/2012 Yamasaki ..... B41J 3/4073 347/2
2012/0287183 A1 * 11/2012 Bitoh ..... A45D 29/00 347/3
2012/0287192 A1 * 11/2012 Yamasaki ..... B41J 3/407 347/14
2013/0038648 A1 * 2/2013 Kasahara ..... B41J 3/407 347/2

(Continued)

FOREIGN PATENT DOCUMENTS

JP 2003534083 A 11/2003
JP 2012085944 A 5/2012

(Continued)

*Primary Examiner* — Ted Barnes
(74) *Attorney, Agent, or Firm* — Holtz, Holtz & Volek PC

(57) ABSTRACT

A drawing apparatus is provided by which quality of a predetermined degree or higher can be preserved in cases of drawing a nail design on a nail; and a drawing method for the drawing apparatus.

The drawing apparatus includes a reference plane on which a finger or toe having a nail is mounted; a drawing unit (40) that draws a nail design on a drawable area in the nail; a nail height detection portion (814) that detects a distribution of height from the reference plane within a surface of the nail, on the basis of an image obtained by imaging the nail; and a design determination portion (815) that determines the suitability of drawing the nail design on the surface of the nail by the drawing unit (40), on the basis of the drawable area based on the distribution by the nail height detection portion (814).

16 Claims, 8 Drawing Sheets

(56) References Cited

U.S. PATENT DOCUMENTS

| | | | | |
|---|---|---|---|---|
| 2014/0060560 | A1* | 3/2014 | Bitoh | A45D 29/00 132/73 |
| 2015/0007841 | A1* | 1/2015 | Yamasaki | A45D 29/00 132/73.5 |

FOREIGN PATENT DOCUMENTS

| | | | |
|---|---|---|---|
| JP | 2012232414 | A | 11/2012 |
| JP | 2014064892 | A | 4/2014 |

* cited by examiner

DRAWING APPARATUS AND DRAWING METHOD FOR DRAWING APPARATUS

CROSS-REFERENCE TO RELATED APPLICATIONS

This application is based upon and claims the benefit of priority from the prior Japanese Patent Application No. 2015-249224, filed Dec. 22, 2015, the entire contents of which are incorporated herein by reference.

BACKGROUND OF THE INVENTION

1. Field of the Invention

The present invention relates to a drawing apparatus and a drawing method for a drawing apparatus.

2. Description of the Related Art

Conventionally, drawing apparatuses for drawing nail designs on nails are known (e.g. see Japanese Unexamined Patent Application Publication (Translation of PCT Application) No. 2003-534083).

Nail designs can be enjoyed readily without visiting a nail salon or the like by using such an apparatus.

With drawing apparatuses (nail printing apparatuses), the use of writing utensils (pens) such as those applied to ink jet drawing heads and pen plotters is being investigated as a means for drawing a nail design such as a color, pattern, or the like on the surface of a nail.

However, the shape of the fingers and nails of humans varies and, thus, it is difficult to arrange the entire region of the nail at a substantially uniform height, even if, for example, the nail free end is set at the correct position in the apparatus.

On this point, ink jet drawing heads perform drawing by ejecting ink as a mist on a drawing object. However, in order to land the ejected ink at the predetermined position, the drawing object must be within the limit of the flying distance of the ejected ink.

Due to this, in cases where some portions of the drawing object, namely the nail, are significantly low in height and a distance between the drawing head and the nail is too great, the ink will not land correctly at the predetermined position and, as the distance increases, the drawing will gradually become faded or distorted. Consequently, drawing quality will degrade. Additionally, in cases where the distance in the height direction between the nail and the drawing head is significantly greater than the expected distance, the ink ejected from the head may not reach the drawing object, namely the nail, and there is a possibility that the drawing may not be able to be performed.

Additionally, in cases of performing drawing using a pen, even if a configuration is adopted in which a height of the pen is vertically movable to a certain degree in accordance with the height of the nail, in a case where the drawing object, namely the nail, is positioned outside of this driving range, the pen tip will not reach the nail and a situation will occur in which the drawing cannot be performed.

In light of the problems described above, an object of the present invention is to provide a drawing apparatus by which quality of a predetermined degree or higher can be preserved in cases of drawing a nail design on a nail; and a drawing method for the drawing apparatus.

SUMMARY OF THE INVENTION

In order to solve the problems described above, a drawing apparatus and a drawing method for the drawing apparatus of the present invention provide the following resolution means.

A drawing apparatus includes an insertion portion into which a finger or toe having a nail is inserted, the insertion portion having a reference plane provided therein, a nail height detection portion that detects a distribution of height from the reference plane within a surface of the nail, on the basis of an image obtained by imaging the nail, a drawing unit that draws a nail design on a drawable area in the nail, the drawable area being defined on the basis of a distance between the nail and the drawing unit, and a design determination portion that determines the suitability of drawing the nail design on the surface of the nail by the drawing unit, on the basis of the drawable area based on the distribution by the nail height detection portion.

In a drawing method for a drawing apparatus, the drawing apparatus includes an insertion portion into which a finger or toe having a nail is inserted, the insertion portion having a reference plane provided therein, and a drawing unit that draws a nail design on a drawable area in the nail, the drawable area being defined on the basis of a distance between the nail and the drawing unit. The drawing method includes detecting a distribution of height from the reference plane within a surface of the nail, on the basis of an image obtained by imaging the nail of the finger or toe, and determining the suitability of drawing the nail design on the surface of the nail by the drawing unit, on the basis of the drawable area based on the distribution.

According to the present invention, quality of a predetermined degree or higher can be preserved in cases of drawing a nail design on a nail.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1B:
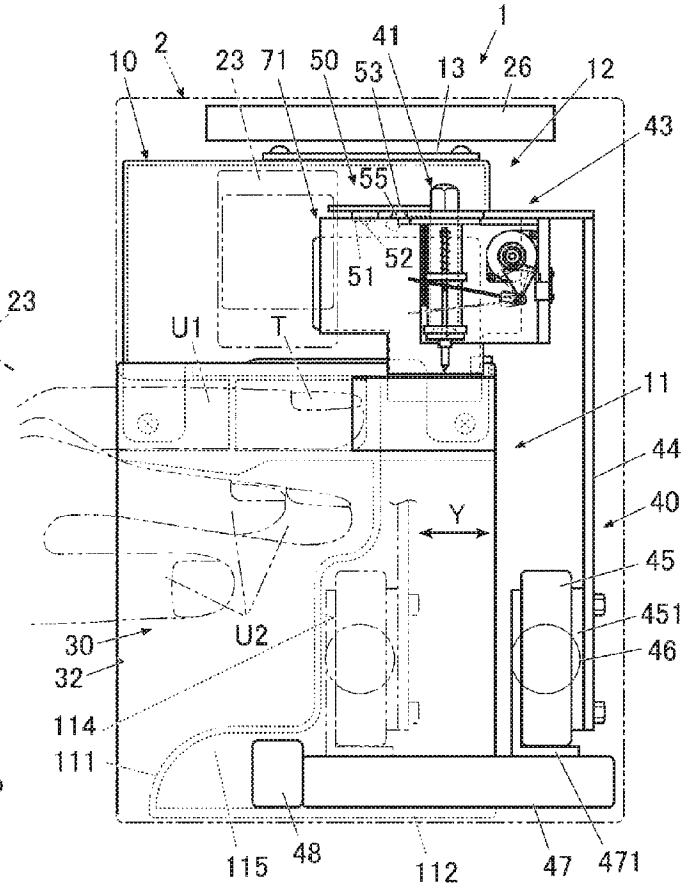
FIG. 1B is a side view illustrating an internal configuration of the drawing apparatus illustrated in FIG. 1A.

An embodiment of a nail printing apparatus (drawing apparatus) and a drawing method for the nail printing apparatus (drawing apparatus) according to the present invention is described below, while referring to FIGS. 1A to 8.

While various limitations, which are technically preferable from the perspective of carrying out the present invention, are placed on the embodiments described below, the scope of the present invention should not be construed to be limited to these embodiments or the examples illustrated in the drawings.

Additionally, in the following embodiments, a nail printing apparatus 1 will be described as an apparatus for drawing on a drawing object, namely a fingernail. However, the drawing object of the present invention is not limited to fingernails, and for example, the drawing object may be a toenail.

Figure 1A:
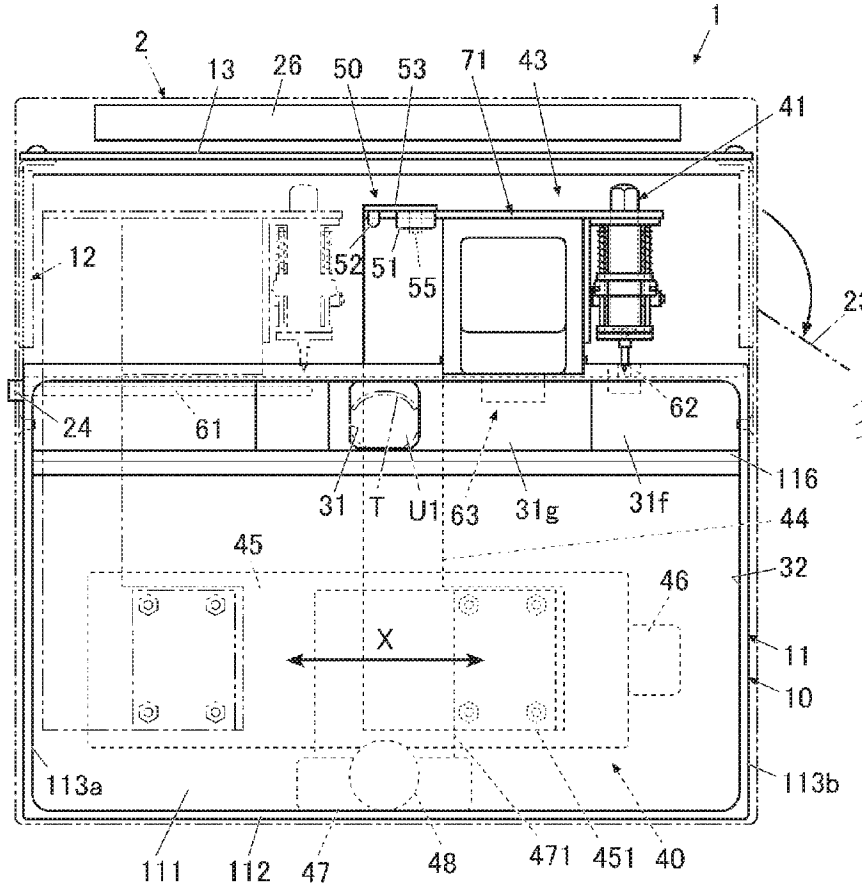
FIG. 1A is a front view of a drawing apparatus according to an embodiment of the present invention.

FIG. 1A is a front view of a nail printing apparatus, illustrating an internal configuration of the nail printing apparatus. FIG. 1B is a side view illustrating the internal configuration of the nail printing apparatus illustrated in FIG. 1A.

As illustrated in FIGS. 1A and 1B, in the nail printing apparatus 1 of the present embodiment, a drawing head 43 is provided with drawing tools, namely a pen 41, and an ink jet drawing portion 71. The nail printing apparatus 1 of the present embodiment uses plotter printing and ink jet printing to perform a drawing on a nail T of a print finger U1.

The nail printing apparatus 1 is provided with a case body 2 and an apparatus main body 10 housed in the case body 2.

A cover 23, configured to be openable and closeable, for replacing the pen 41 and the ink jet drawing portion 71 of the hereinafter described drawing unit 40 is provided in an edge of an upper portion of a side surface of the case body 2. The cover 23 is rotatable via, for example, a hinge or the like, from a closed state to an open state, as illustrated in FIGS. 1A and 1B.

An operation unit 25 (see FIG. 4) is set on an upper surface (top panel) of the case body 2.

The operation unit 25 is an input unit where a user performs various types of input.

Operation buttons (not illustrated) for performing various types of input are set in the operation unit 25. Examples of the operation buttons include a power switch button for turning on the power of the nail printing apparatus 1, a stop switch button for stopping operation, a design selection button for selecting a design image to be drawn on the nail T, a drawing start button for commanding the drawing to start, and the like.

Additionally, a display unit 26 is set approximately in a center portion of the top surface (top panel) of the case body 2.

The display unit 26 is configured from, for example, a liquid crystal display (LCD), an organic electroluminescence display, or other type of flat display.

In the present embodiment, examples of images appropriately displayed on the display unit 26 include nail images obtained by imaging the print finger U1 (finger images including images of the nail T), images of the outline or the like of the nail T included in the nail images, design selection images for selecting a design image to be drawn on the nail T, thumbnail images for design confirmation, command screens displaying various commands, and the like.

Additionally, in the present embodiment, as described later, a configuration is provided in which the display unit 26 is caused to display a notification screen for informing a user of the suitability of the drawing of a nail design on the nail T, on the basis of a determination result by a design determination portion 815 (see FIG. 4). Thus, the display unit 26 functions as a notification means.

Figure 4:
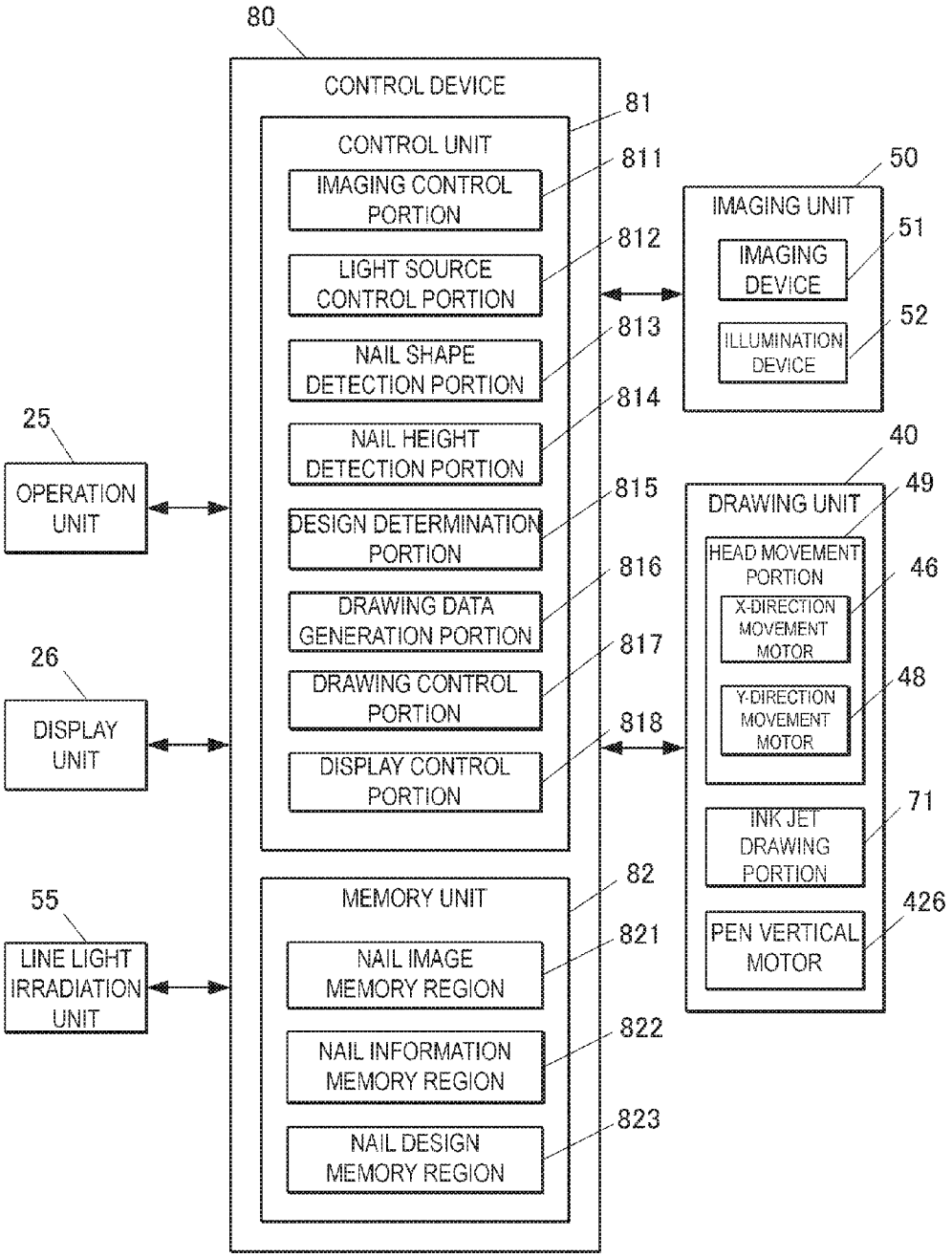
FIG. 4 is a main constituent block diagram showing a control configuration of the drawing apparatus according to the embodiment of the present invention.

Additionally, a configuration is provided in which the display unit 26 is caused to display a design presentation screen for presenting a user with nail designs suitable for drawing, on the basis of the determination result by the design determination portion 815 (see FIG. 4). Thus, the display unit 26 functions as design presentation means.

Furthermore, a configuration is provided in which the display unit 26 is caused to display an expected finish presentation screen for presenting an expected finish of a case where a nail design selected by the user is drawn on the nail T, on the basis of the determination result by the design determination portion 815 (see FIG. 4). Thus, the display unit 26 functions as expected finish presentation means.

Note that a configuration is possible in which a touch panel for performing various types of input is integrated into the surface of the display unit 26.

The apparatus main body 10 is formed into a rough box-shape and is provided with a lower frame 11 set in the lower portion of the interior of the case body 2, and an upper frame 12 set above the lower frame 11 and in the upper portion of the interior of the case body 2.

First, the lower frame 11 will be described.

The lower frame 11 has a back surface plate 111, a bottom plate 112, a pair of left and right side plates 113*a* and 113*b*, an X-direction movement stage housing 114, a Y-direction movement stage housing 115, and a dividing wall 116.

Bottom edges of the side plates 113*a* and 113*b* are joined respectively to left and right edges of the bottom plate 112. The side plates 113*a* and 113*b* are provided in an upright state on the bottom plate 112.

A lower portion of the back surface plate 111 is formed so as to sink forward (toward the finger insertion direction proximal side) in two stages. The bottom edge of the back surface plate 111 is joined to a front edge of the bottom plate 112, and the back surface plate 111 divides the area surrounded by the bottom plate 112 and the side plates 113*a* and 113*b* into front and back.

The space formed on the back side of the sunken back surface plate 111 becomes the X-direction movement stage housing 114 and the Y-direction movement stage housing 115 (see FIG. 1B). An X-direction movement stage 45 of the drawing unit 40 is housed in the X-direction movement stage housing 114 when the drawing unit 40 is moved forward (toward the finger insertion direction proximal side). Additionally, a Y-direction movement stage 47 of the drawing unit 40 is disposed in the Y-direction movement stage housing 115.

Additionally, the dividing wall 116 is provided inside the lower frame 11 so as to vertically divide the space on the front side inside the lower frame 11 (the space on the finger insertion direction proximal side surrounded by the back surface plate 111, the bottom plate 112, and the side plates 113*a* and 113*b*). The dividing wall 116 is provided roughly horizontally, left and right edges of the dividing wall 116 are joined respectively to the side plates 113*a* and 113*b*, and a back edge of the dividing wall 116 is joined to the back surface plate 111.

A finger securing portion 30 (see FIG. 1B) is provided integrally in the lower frame 11.

The finger securing portion 30 is configured from a finger receiving portion 31 for receiving the finger corresponding to the nail T (i.e. the drawing object) on which drawing will be applied (hereinafter referred to as "print finger U1"), and a finger clearing portion 32 for clearing fingers other than the print finger U1 (hereinafter referred to as "non-print fingers U2").

The finger receiving portion 31 is disposed on an upper side of the dividing wall 116 and, for example, slightly right of the center in a width direction of the lower frame 11. Additionally, the space on the lower side of the lower frame 11, partitioned by the dividing wall 116, forms the finger clearing portion 32.

For example, in cases where performing a drawing on the nail T of a ring finger, the ring finger is inserted into the finger receiving portion 31 as the print finger U1, and the non-print fingers U2, namely the other four fingers (thumb, index finger, middle finger, and little finger) are inserted into the finger clearing portion 32.

The finger receiving portion 31 is open to a front surface side of the lower frame 11 (print finger insertion direction proximal side); and a bottom side is a mounting surface 116*a* that constitutes a portion of the dividing wall 116. The mounting surface 116*a* is a constituent where the finger (the print finger U1) of the nail T on which drawing is to be performed is mounted on the X-Y plane.

Additionally, a top side of the finger receiving portion 31 is open and a surface of the nail T of the print finger U1 that is inserted in the finger receiving portion 31 (i.e. the drawing object surface) is exposed.

Figure 3:
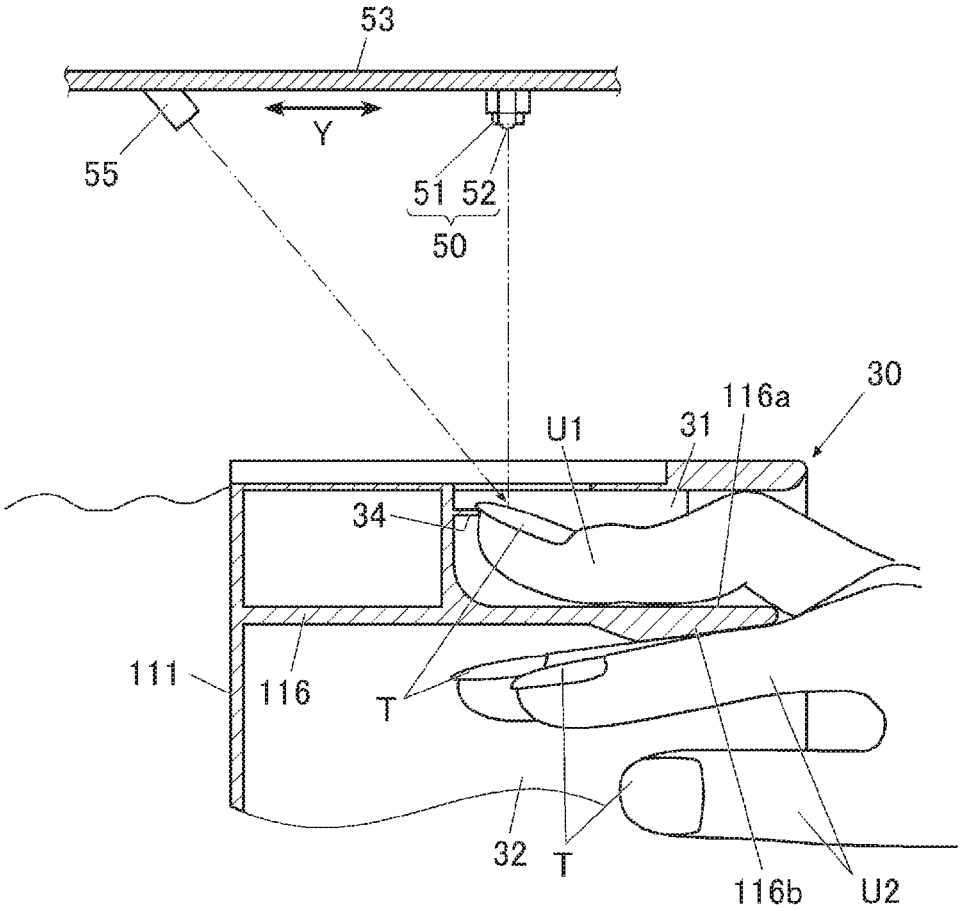
FIG. 3 is an explanatory drawing illustrating positional relationships between a finger set in a finger receiving portion, a line light irradiation unit, and an imaging unit.

Additionally, as illustrated in FIG. 3, a nail stand 34 protruding from the apparatus back side toward the proximal side is provided on the apparatus back side within the finger receiving portion 31 of the present embodiment. A user places a free end portion of the nail T of the print finger U1 on the nail stand 34 and, thereby fixes the position in the height direction of the free end portion of the nail T.

Additionally, a front wall 31*f* (see FIG. 1A) that closes the front surface side of the lower frame 11 is erected on the top surface of the dividing wall 116, at both end portions on the front surface side of the lower frame 11. Additionally, a pair of guide walls 31*g* (see FIG. 1A) that guides the print finger U1 into the finger receiving portion 31 is erected on the top surface of the dividing wall 116, and the pair of guide walls 31*g* narrows from the end of the front wall 31*f* on the center portion side toward the finger receiving portion 31.

A user can pinch the dividing wall 116 between the print finger U1 inserted into the finger receiving portion 31 and the non-print fingers U2 inserted into the finger clearing portion 32. Thus, the print finger U1 inserted into the finger receiving portion 31 is stably secured.

A warm-up drawing portion 61 is provided on the top surface of the lower frame 11, beside the finger receiving portion 31 (location corresponding to a media access port 24 of the case body 2, on the left side in FIG. 1A in the present embodiment). The warm-up drawing portion 61 is for performing warm-up drawing to eliminate fading and the like at a time of beginning of drawing by a pen tip (tip portion) 413 of the pen 41 (described hereinafter) within a drawable area of the drawing head 43 (described hereinafter).

The warm-up drawing portion 61 is a flat portion and is configured so that drawing media (not illustrated) inserted through the media access port 24 of the case body 2 is mounted thereon.

The drawing media mounted on the warm-up drawing portion 61 is not limited, provided that warm-up drawing of the pen tip (tip portion) 413 can be performed, and for example, may be a piece of paper.

A pen cap 62 is disposed within a movable range of a drawing head 43 (described hereinafter) on the top surface of the lower frame 11, on a side opposite the warm-up drawing portion 61 across the finger receiving portion 31 (on the right side of FIG. 1A in the present embodiment). The number of the pen cap 62 disposed (one in the present embodiment) corresponds to the number of a pen holder 42 (described hereinafter).

The pen cap 62 is formed, for example, from rubber, and at times when the pen 41 is mounted on the drawing unit 40 but not drawing (when not drawing), drying out of the pen tip 413 is prevented by lowering the pen 41 and storing the pen tip 413 in the pen cap 62.

Additionally, an ink jet maintenance portion 63 is provided at a position corresponding to a position where the ink jet drawing portion 71 is disposed when the pen tip 413 is stored in the pen cap 62. The ink jet maintenance portion 63 is configured from, for example, a cleaning mechanism for cleaning an ink discharging portion (nozzle surface) of the ink jet drawing portion 71 described hereinafter, a cap mechanism for maintaining moist conditions of the ink discharging portion (nozzle surface), and the like (all not illustrated).

Note that the disposal of the pen cap 62, the ink jet maintenance portion 63, and the like is not limited to the examples described herein.

The drawing unit 40 is configured from and provided with the drawing head 43, a unit supporting member 44 that supports the drawing head 43, the X-direction movement stage 45 for moving the drawing head 43 in the X direction (the X direction in FIG. 1A; the left-right direction of the drawing apparatus 1), an X-direction movement motor 46, the Y-direction movement stage 47 for moving the drawing head 43 in the Y direction (the Y direction in FIG. 1B; the front-back direction of the drawing apparatus 1), a Y-direction movement motor 48, and the like.

Figure 2A:
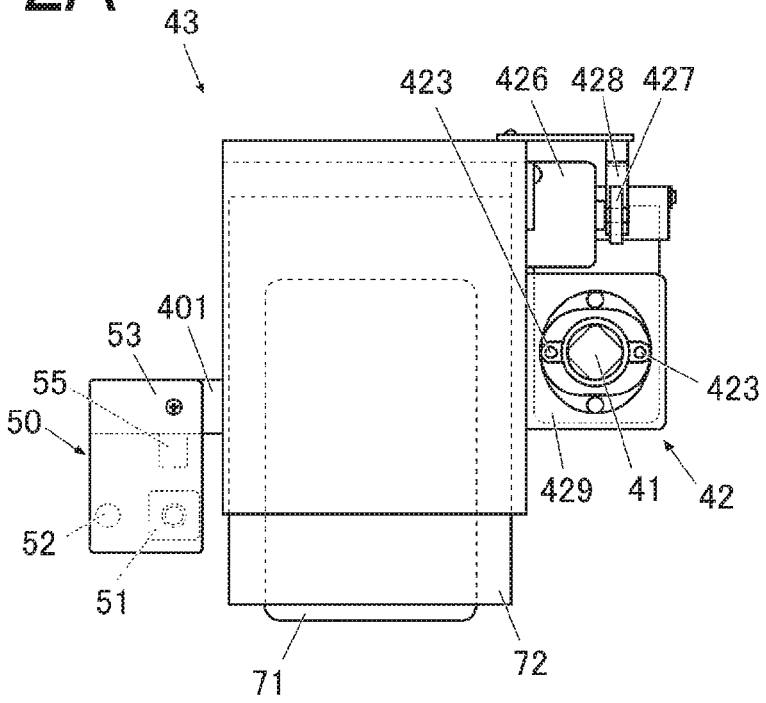
FIG. 2A is a top view of a drawing head according to the embodiment of the present invention.
Figure 2B:
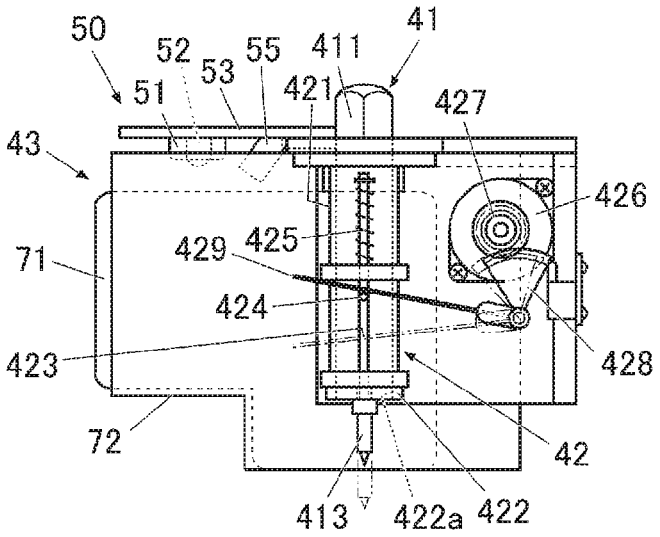
FIG. 2B is a side view of the drawing head according to the embodiment of the present invention.

FIG. 2A is a top view of a drawing head and FIG. 2B is a side view of the drawing head according to the present embodiment.

As illustrated in FIGS. 2A and 2B, in a drawing head 43 of the present embodiment, the pen holder 42 holding the pen 41 and an ink jet holder 72 holding the ink jet drawing portion 71 are disposed adjacently to each other.

The ink jet drawing portion 71 is, for example, an ink cartridge-integrated head in which ink cartridges (not illustrated) corresponding to yellow (Y), magenta (M), and cyan (C) ink are formed integrally with an ink discharging portion (not illustrated) provided on a surface (in the present embodiment, the bottom surface in FIG. 1A and the like) facing the drawing object (the nail T) in each of the ink cartridges. The ink discharging portion is provided with a nozzle array consisting of a plurality of nozzles for spraying each color of ink. The ink jet drawing portion 71 micronizes the ink and performs the drawing by spraying the ink from the ink discharging portion directly on the target drawing surface of the drawing object (the nail T). Note that the ink jet drawing portion 71 is not limited to those that discharge the three colors of ink described previously. Ink cartridges holding other ink and ink discharging portions may also be provided.

The ink drawing portion 71 performs drawing by spraying ink from the ink discharging portion. In cases where a distance between the ink discharging portion and the drawing object, namely the nail T, is too great, accurate control of the ink landing position becomes impossible. Upon exceeding a certain distance, the drawing gradually becomes faded or distorted and, consequently, drawing quality degrades. If the distance is further increased, the ink will not reach the nail T at all and drawing becomes impossible. As such, in order to preserve a certain drawing quality, a drawable area (drawable range) in the height direction (e.g. the distance from the nail T to the ink discharging portion is about 8 mm) is set for the ink jet drawing portion 71 so that the distance from the nail T is within a predetermined value.

Note that the distance at which the certain drawing quality can be preserved differs depending on the performance of the ink discharging portion and the type of ink discharged. As such, the degree to which the drawable range of the ink jet drawing portion 71 in the height direction is set may be appropriately set in accordance with such various conditions.

One pen 41 is mountable in the pen holder 42 of the present embodiment.

The pen 41 is a writing utensil that has the surface of the nail T as its drawing object surface, and performs a drawing by the tip portion thereof being brought into contact with the drawing object surface, namely the surface of the nail T.

As illustrated in FIG. 2B and the like, the pen 41 is provided with the pen tip 413 on a tip end side (the lower side in FIG. 2B) of a rod-like pen shaft portion 411.

An interior of the pen shaft portion 411 is an ink storing portion for storing various types of ink.

Any type of ink can be stored in the interior of the pen shaft portion 411. Viscosity of ink, diameter of the coloring particles (particle size), and the like are not particularly limited and, for example, ink containing metallic glitter, white ink, UV-curable ink, ink for gel nails, ink for under coats, ink for top coats, nail varnish, and the like can be used.

In the present embodiment, the pen 41 is a ballpoint pen in which the pen tip 413 draws by the ink stored in the pen shaft portion 411 being dispensed by pressing the pen tip 413 against the surface of the nail T.

Note that the pen 41 is not limited to a ballpoint pen. For example, the pen 41 may be a felt-tip pen that draws by soaking ink into a felt-like pen tip, a brush pen that draws by soaking ink into a bundle of hairs, or the like.

The pen 41 having the pen tip 413 of any desired thickness may be provided as well.

The pens 41 held in the pen holder 42 may be pens that all have the same type of the pen tip 413, or may be pens that have different types of the pen tip 413.

The pen 41 is held by simply inserting it in the pen holder 42 from above. As such, the pen 41 can be easily replaced by opening the cover 23 provided in the case body 2 and, for example, using hands or tweezers to grab a top end portion of the pen shaft portion 411 and lift the pen 41 out.

Thus, a user can realize a wide range of nail designs by appropriately replacing the pen 41 set in the pen holder 42 for a pen 41 having a different color or a different pen tip 413, or using a different type of ink, depending on the nail design desired to be drawn.

The pen holder 42 is provided with a tubular member 421 that is open vertically and into which the pen 41 is inserted, a pen retaining member 422 disposed so as to block an opening on a bottom side of the tubular member 421 (the bottom side in FIG. 2B), and an auxiliary rod member 423 that moves vertically with the pen 41.

A retaining hole 422*a* that retains the tip side of the pen shaft portion 411 of the pen 41 is formed in the pen retaining member 422. The pen 41 is retained in the pen holder 42 by the tip side of the pen shaft portion 411 being inserted in the retaining hole 422*a* of the pen retaining member 422. Note that screw grooves (not illustrated) may be formed in an outer circumferential surface of the tip side of the pen shaft portion 411, screw grooves (not illustrated) capable of mating with the screw grooves of the shaft portion may be formed in an inner circumferential surface of the retaining hole 422*a*, and the pen 41 may be retained in the retaining hole 422*a* by screwing the screw grooves on the pen shaft portion 411 side into the screw grooves on the retaining hole 422*a* side.

In the present embodiment, two auxiliary rod members 423 are disposed so as to sandwich the pen 41. A bottom end of each of the auxiliary rod members 423 is mated with the pen retaining member 422 and, thereby, the auxiliary rod members 423 are fixed so as to be parallel with the pen shaft portion 411 of the pen 41.

A retaining protrusion 424 protruding in a direction away from the axial center of the pen 41 is provided on the auxiliary rod members 423.

Additionally, a coil spring 425 is wrapped around the rod of each of the auxiliary rod members 423. The coil springs 425 are configured to apply force in an upward direction to the auxiliary rod members 423 in a state free of external forces and holds the position of the pen 41 when not drawing at a position where the pen tip 413 does not come into contact with the nail T.

A pen vertical motor 426 constituted by a stepping motor, a gear 428 that engages with a gear 427 attached to a rotating shaft of the pen vertical motor 426, and a plate spring 429 that pivots along with the rotation of the gear 428 are provided in the vicinity of the pen holder 42. In the present embodiment, a lifting mechanism of the pen 41 is constituted by the pen vertical motor 426, the gear 427, the gear 428, the plate spring 429, and the like.

When not drawing, the plate spring 429 does not apply external forces to the retaining protrusion 424 and, in this state, the pen 41 is pushed in an upward direction (the upward direction in FIGS. 1A and 2B) by the biasing force of the coil springs 425. Thus, the tip portion of the pen 41, namely the pen tip 413, is separated from the drawing object surface, namely the surface of the nail T, and held at a height where the pen tip 413 does not come into contact with the surface.

On the other hand, when drawing, the pen vertical motor 426 rotates a prescribed number of steps, resulting in the plate spring 429 pivoting. At this time, the plate spring 429 engages with the retaining protrusion 424 provided on the auxiliary rod member 423 and presses the retaining protrusion 424 downward. Thus, the pen 41 is pressed downward against the biasing force of the coil spring 425, and the pen tip 413 comes into contact with the surface of the nail T. The plate spring 429 flexes a suitable degree and, as a result, impact caused by the vertical movement of the pen 41 is absorbed by the plate spring 429 and the pen 41 moves vertically along with the height of the nail T while maintaining a suitable degree of pen pressure of the pen tip 413 in a roughly constant manner. Thus, the desired nail design can be drawn neatly on the surface of the drawing object, namely the nail T.

As described above, the pen 41 performs drawing with the pen tip 413 directly in contact with the surface of the nail T. In cases where the distance between the pen tip 413 and the drawing object, namely the surface of the nail T, is too great, the pen tip 413 will not reach the nail T and drawing will become impossible. As such, in order to preserve a certain drawing quality, a drawable range in the height direction (e.g. the distance from the nail T to the ink discharging portion is about 5 mm) is set for the pen 41 so that the distance from the nail T is within a predetermined value.

Note that the distance at which the certain drawing quality can be preserved differs depending on the vertical movable range of the pen 41. As such, the degree to which the drawable range of the pen 41 in the height direction is set may be appropriately set in accordance with the type of the pen 41, the configuration of the lifting mechanism, and the like.

Additionally, the unit supporting member 44 is fixed to the X-direction movement portion 451 that is attached to the X-direction movement stage 45. The X-direction movement portion 451 is configured to move on the X-direction movement stage 45 in the X direction along a guide (not illustrated) due to the driving of the X-direction movement motor 46. Thus, the drawing head 43 that is attached to the unit supporting member 44 is configured to move in the X direction (the X direction in FIG. 1A and the left-right direction of the nail printing apparatus 1).

Additionally, the X-direction movement stage 45 is fixed to a Y-direction movement portion 471 of the Y-direction movement stage 47. The Y-direction movement portion 471 is configured to move on the Y-direction movement stage 47 in the Y direction along a guide (not illustrated) due to the driving of the Y-direction movement motor 48. Thus, the drawing head 43 that is attached to the unit supporting member 44 is configured to move in the Y direction (the Y direction in FIG. 1B and the front-back direction of the nail printing apparatus 1).

Note that in the present embodiment, the X-direction movement stage 45 and the Y-direction movement stage 47 are configured from combinations of the X-direction movement motor 46, the Y-direction movement motor 48, and ball screws and guides (not illustrated).

In the present embodiment, a head movement portion 49 is configured as an XY drive unit that drives the drawing head 43 provided with the pen 41 in the X direction and the Y direction via the X-direction movement motor 46, the Y-direction movement motor 48, and the like.

The pen vertical motor 426, the ink jet drawing portion 71, the X-direction movement motor 46, and the Y-direction movement motor 48 of the drawing unit 40 are connected to a drawing control portion 817 of a control device 80 (see FIG. 4; described hereinafter), and are configured to be controlled by the drawing control portion 817.

Additionally, the imaging unit 50 is provided with the image capturing device 51 and an illumination device 52.

The imaging unit 50 illuminates the nail T of the print finger U1, which is inserted into the finger receiving portion 31 and is visible through the opening of the upper portion, using the illumination device 52. Moreover, the print finger U1 is imaged using the image capturing device 51 and, a captured image of the nail T of the print finger U1, namely a nail image (image of finger including a nail image) is acquired.

In the present embodiment, the image capturing device 51 and the illumination device 52 are fixed on a side (the left side of the drawing head 43 in FIG. 1A) of the drawing head 43 of the drawing unit 40.

Specifically, as illustrated in FIG. 2A, the drawing head 43 of the drawing unit 40 has an overhanging portion 401 overhanging in a lateral direction from a first edge (the left side in FIG. 2A) of the top surface of the drawing head 43, and a substrate 53 is attached to the overhanging portion 401. The image capturing device 51 and the illumination device 52 constituting the imaging unit 50 are provided on a bottom surface of the substrate 53 so as to face the dividing wall 116.

Note that a size of the substrate 53 and positions where the image capturing device 51 and the illumination device 52 are attached to the substrate 53 are not particularly limited.

The image capturing device 51 is, for example, a small camera having a solid state image sensor with a pixel count of about 2 million pixels or greater, a lens, and the like.

In the present embodiment, a nail shape detection portion 813 (see FIG. 4) detects the shape of the nail T (the outline of the nail T), the position of the nail T on the X-Y plane, the vertical position of the nail T, and other nail information, on the basis of the captured image (the nail image) acquired by the image capturing device 51.

Note that in order to detect the curvature and the like of the nail T of the print finger U1, the image capturing device 51 may be configured to be moved by the head movement portion 49 so as to image the nail T from differing positions or angles and acquire a plurality of captured images (nail images).

In cases where the image capturing device 51 acquires a plurality of captured images (nail images), the nail shape detection portion 813 (see FIG. 4) can detect the curvature of the nail T on the basis of these captured images (nail images).

Additionally, in the present embodiment, the image capturing device 51 is configured to image the surface of the nail T which has been irradiated with line light from a line light irradiation unit 55 (described hereinafter), and acquire an image of the nail T, namely a line image, including a line La (see FIG. 5B) formed on the nail T by the line light. The number of line images acquired is not particularly limited, but it is preferable that the position to be irradiated with the line light be changed along the length of the nail T, imaging be performed a plurality of times, and two or more line images be acquired.

The illumination device 52 is, for example, a white LED or similar light source.

In the present embodiment, the illumination device 52 is disposed beside the image capturing device 51 (on the left side of the image capturing device 51 in FIGS. 1A and 2B). The illumination device 52 emits light downward to illuminate at least an imaging area below the image capturing device 51. The position of the illumination device 52 with respect to the image capturing device 51 is fixed. Note that the disposal and number of the illumination devices 52 provided is not limited to the illustrated examples.

The imaging unit 50 is connected to an imaging control portion 811 of the control device 80 (described hereinafter, see FIG. 4), and is configured to be controlled by the imaging control portion 811.

Note that image data of the images captured by the imaging unit 50 are stored in a nail image memory region 821 of a memory unit 82 (described hereinafter).

As illustrated in FIGS. 2A and 2B, the line light irradiation unit 55 is provided on the lower surface of the substrate 53 where the imaging unit 50 is provided and on the apparatus back side (that is, on the right side in FIG. 1B) of the image capturing device 51.

In the present embodiment, the line light irradiation unit 55 includes a light source (not illustrated) that emits, for example, laser light, and a silt portion (not illustrated) for changing the light from the light source to straight line (line-shaped) light. The line light irradiation unit 55 projects the light from the light source through the slit portion, resulting in the object being irradiated with line-shaped light (line light). Note that light of a wavelength band that is discernible by the image capturing device 51 is used for the laser light of the line light irradiation unit 55.

The line light irradiation unit 55 is set at an angle at which the line light diagonally illuminates the mounting surface 116*a*, from the apparatus back side toward the finger receiving portion 31.

As such, as illustrated in FIG. 3, a configuration is provided in which the line light illuminates the print finger U1 inserted in the finger receiving portion 31 and the nail T thereof, from diagonally above, that is, offset from directly above the nail T in the extending direction of the finger (in the present embodiment, diagonally above the nail free end direction).

Note that the line light irradiation unit 55 is not limited to a configuration which emits line light. For example, the line light irradiation unit 55 may scan in a width direction while irradiating the nail T with beam-shaped light.

The line light irradiation unit 55 is connected to a light source control portion 812 of the control device 80 (described hereinafter, see FIG. 4), and is configured to be controlled by the light source control portion 812.

The control device 80 is, for example, set on a substrate 13 or the like disposed in the upper frame 12.

FIG. 4 is a main constituent block diagram showing the control configuration according to the present embodiment.

As illustrated in FIG. 4, the control device 80 is a computer provided with a control unit 81 constituted by a central processing unit (CPU) (not illustrated), and a memory unit 82 constituted by a read only memory (ROM), a random access memory (RAM), or the like (neither illustrated).

Various programs, various data, and the like to operate the nail printing apparatus 1 are stored in the memory unit 82.

Specifically, various programs are stored in the ROM of the memory unit 82 such as a nail information detection program for detecting the shape (outline) and other nail information on the nail T from the nail image (the captured image); a design determination program that determines whether or not a nail design is suited for drawing on the nail T; a drawing data generation program for generating drawing data; a drawing program for performing drawing processing; and the like. These programs are executed by the control device 80 and, thus, the components of the nail printing apparatus 1 are subjected to integrated control.

Additionally, in the present embodiment, the memory unit 82 is provided with the nail image memory region 821 where the nail image (captured image) of the nail T of the print finger U1 of a user acquired by the imaging unit 50 is stored, a nail information memory region 822 where the nail information detected by the nail shape detection portion 813 (coordinate values of the shape/outline of the nail T, the curvature of the nail T, and the like) is stored, and a nail design memory region 823 where image data of a nail design to be drawn on the nail T is stored.

When viewed from a function perspective, the control unit 81 is provided with the imaging control portion 811, the light source control portion 812, the nail shape detection portion 813, a nail height detection portion 814, the design determination portion 815, a drawing data generation portion 816, the drawing control portion 817, a display control portion 818, and the like. Functions of the imaging control portion 811, the light source control portion 812, the nail shape detection portion 813, the nail height detection portion 814, the design determination portion 815, the drawing data generation portion 816, the drawing control portion 817, the display control portion 818, and the like are realized by cooperation of the CPU of the control unit 81 and the programs stored in the ROM of the memory unit 82.

The imaging control portion 811 is configured to control the image capturing device 51 and the illumination device 52 of the imaging unit 50 to cause the image capturing device 51 to image finger images, that is, nail images (captured images) including images of the nail T of the print finger U1 inserted into the finger receiving portion 31.

Additionally, the imaging control portion 811 is configured to control the image capturing device 51 and the illumination device 52 of the imaging unit 50 to image, from above, the nail T irradiated with the line light from the line light irradiation unit 55, and acquire a line image, namely a nail image (captured image), that includes an image of a line La (see FIG. 5B) formed by the line light.

Note that it is preferable that a plurality of the line images that include images of the line La be acquired while changing an irradiation position of the line light from the line light irradiation unit 55 along the length direction of the nail T. In this case, the irradiation position of the line light is appropriately changed by the drawing control portion 817 controlling the head movement portion 49 to move the position of the line light irradiation unit 55 together with the substrate 53.

Note that the number of captured images (line images) to be acquired for one nail T is not particularly limited, but it is preferable that two or more images captured at different positions be acquired because it will be possible to more accurately detect the shape in the height direction of the nail T.

The image data of the captured image, that is, the nail image and the line image acquired by the imaging unit 50 is stored in the nail image memory region 821 of the memory unit 82.

The light source control portion 812 controls the operations of the line light irradiation unit 55.

In the present embodiment, the light source control portion 812 is configured to diagonally angle the line light from above the nail free edge side toward the nail root side, and project this line light from the line light irradiation unit onto the nail T.

The nail shape detection portion 813 is configured to detect the nail information on the nail T of the print finger U1 on the basis of the images (captured images) of the nail T of the print finger U1 inserted into the finger receiving portion 31, the images being captured by the image capturing device 51.

In the present embodiment, the nail shape detection portion 813 includes, for example, the shape (outline), X-Y coordinates of the horizontal position of the nail T, the shape in the width direction of the nail T, that is, an angle of inclination of the surface of the nail T with respect to the X-Y plane (the curvature of the nail T, the angle of inclination of the nail T), and the like, based on the nail images (the captured images).

The technique by which the nail shape detection portion 813 detects the shape (the outline) of the nail T is not particularly limited, and, for example, can be performed through edge detection processing or similar image processing.

Note that the nail information acquired by the nail shape detection portion 813 is not limited to that described by way of example above. The nail information may be part of that described above, or various types of other information not detailed herein may be detected as the nail information.

The nail height detection portion 814 detects height information on the nail T (position information of the vertical direction of the nail T) on the basis of the nail images (the captured images). In the present embodiment, the nail height detection portion 814 detects height information indicating a distribution of heights from the mounting surface 116*a* within the surface of the nail T, on the basis of the line images, which are the nail images (the captured images) that include the images of the line La, captured with the nail T irradiated with the line light.

Figure 5A:
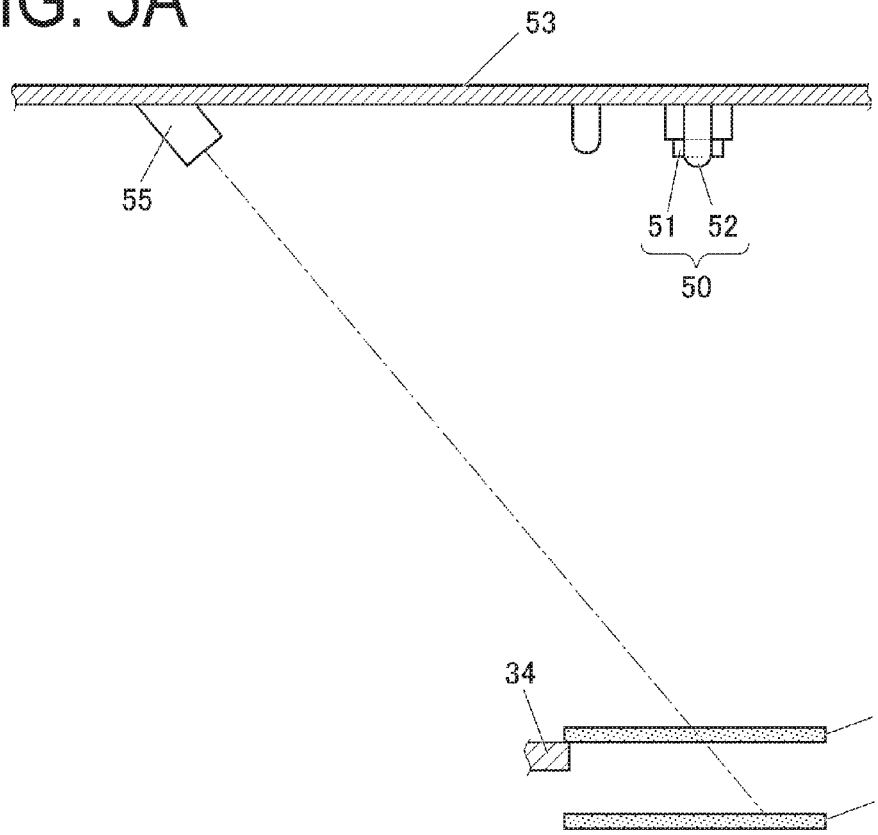
FIG. 5A is a schematic drawing illustrating a position where the line light hits in a case where objects at differing height positions are irradiated with the line light.

As illustrated in FIG. 5A, in cases where the nail T is irradiated with the line light from the line light irradiation unit 55, the position where the light hits differs depending on the height of the object, namely the nail T. Note that in FIG. 5A, the nail is schematically represented as plate-like objects T1 and T2.

A free end portion of the object T1 is mounted on the nail stand 34, and an entirety of the object T1 is held at substantially the same height. In this case, the line light illuminates a relatively proximal side in the illumination direction (in FIG. 5A, the free end side of the nail, namely the object T1).

In contrast, in a case where an entirety of the object T2 is positioned lower than the nail stand 34, the line light illuminates a relatively distal side in the illumination direction (in FIG. 5A, the root side of the nail, namely the object T2).

Figure 5B:
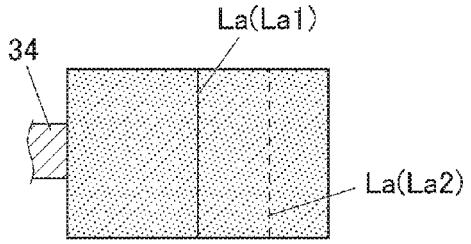
FIG. 5B is a schematic plan view of the objects in FIG. 5A.

FIG. 5B schematically illustrates the positions of the line La formed by the line light illuminating the objects T1 and T2 illustrated in FIG. 5A. The line La (line La1) of a case where the line light illuminates the object T1 that is held at substantially the same height as the nail stand 34 is depicted as a solid line. The line La (line La2) of a case where the line light illuminates the object T2 that is positioned lower than the nail stand 34 is depicted as a dashed line.

As illustrated in FIG. 5B, increased heights of the objects T1 and T2 result in the line La appearing at a position more to the illumination direction proximal side of the line light in the captured images (the line images); and reduced heights of the objects T1 and T2 result in the line La moving to a position on the illumination direction distal side.

In the present embodiment, the nail height detection portion 814 calculates the height information indicating a distribution of heights from the mounting surface 116*a* within the surface of the object, namely the nail T, on the basis of such changes in position of the line La that is formed by the line light.

Note that the technique by which the nail height detection portion 814 detects the height information is not limited to that described herein.

The shape of the fingers and nails of humans varies, and even in cases where the free end portion of the nail T is set on the nail stand 34 and positioning in the height direction is carried out, as illustrated in FIG. 3, the height of the root portion may be lower than that of the free end portion.

In such a case, on the free end side of the nail T, the line La appears at a position on the illumination direction proximal side of the line light in the captured images (the line images); and with movement to the root side of the nail T, the line La appears at a position on the illumination direction distal side of the line light. Due to the line La appearing in such a manner, in cases where the nail T is such as that illustrated in FIG. 3, the nail height detection portion 814 can detect that the nail T on the free end side is greater in height and that the nail T on the root side is lower.

The design determination portion 815 determines the suitability of drawing a nail design on the surface of the nail T on the basis of the drawable range based on the distribution by the nail height detection portion 814.

In the present embodiment, the design determination portion 815 first creates a height map of the nail T on the basis of the height information detected by the nail height detection portion 814.

Figure 6A:
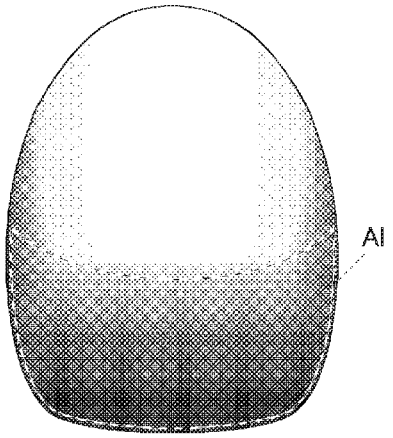
FIG. 6A is a plan view illustrating an example of a height map created by a nail height detection portion.

FIG. 6A illustrates an example of a height map of the nail T created by the design determination portion 815.

In FIG. 6A, the height map is illustrated so that portions of greater height are lighter in color and portions of lesser height are darker. Note that the height map is not limited to that illustrated herein.

The design determination portion 815 detects a portion in the height map that is lower in height (darker in FIG. 6A) than a predetermined value or greater as an unsuitable drawing area A1 (illustrated as the area surrounded by dashed lines in FIGS. 6A to 6C), which is unsuitable for drawing.

Here, the "predetermined value" is set while taking the drawable range in the height direction of the drawing unit 40 into consideration.

For example, in cases where drawing using the ink jet drawing portion 71, in a case where the limit of the distance at which the ink jet drawing portion 71 can accurately land ink at a predetermined position is 8 mm, the design determination portion 815 determines from the detection results of the nail height detection portion 814 a height at which the distance between the nail T and the ink discharging portion of the ink jet drawing portion 71 is greater than or equal to 8 mm to be the predetermined value, and determines portions of the nail T lower in height than the predetermined value or greater to be the unsuitable drawing area A1.

Additionally, in cases where drawing using the pen 41, in a case where the limit of the distance that the pen 41 can be vertically driven is 5 mm, the design determination portion 815 determines from the detection results of the nail height detection portion 814 a height at which the distance between the nail T and an initial position of the pen tip of the pen 41 is greater than or equal to 5 mm to be the predetermined value, and determines portions of the nail T lower in height than the predetermined value or greater to be the unsuitable drawing area A1.

In the present embodiment, the shape of the nail T is detected by the nail shape detection portion 813 and the height information is detected by the nail height detection portion 814; and the design determination portion 815 sets the portion, among regions of the nail T, that is unsuitable for drawing as the unsuitable drawing area A1. Then, the design determination portion 815 fits images formed from the image data of the nail designs stored in the nail design memory region 823 to the nail T for which the unsuitable drawing area A1 has been set, and determines whether or not each of the nail designs will run into the unsuitable drawing area A1.

Figure 6B:
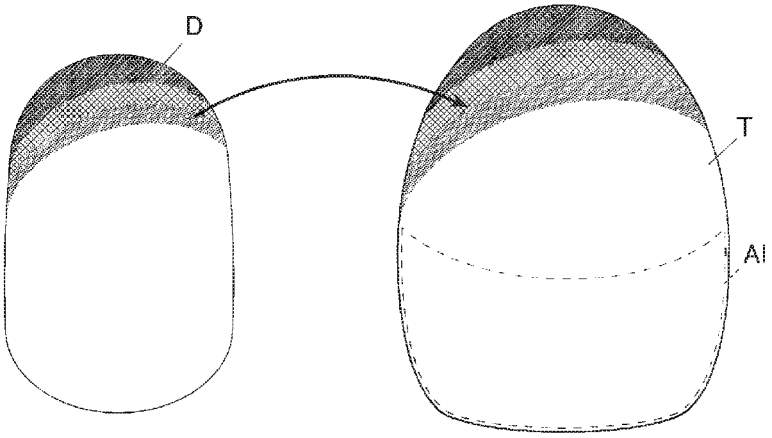
FIG. 6B is a plan view illustrating a state in which a French manicure nail design is fitted to the nail.
Figure 6C:
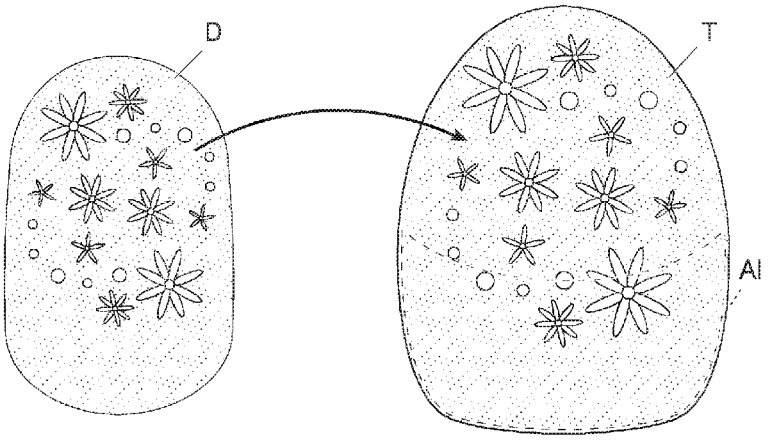
FIG. 6C is a plan view illustrating a state in which an entire surface pattern nail design is fitted to the nail.

For example, in cases where the unsuitable drawing area A1 is the region demarcated by the dashed lines in FIGS. 6A to 6C, when fitting an image of a French manicure nail in which drawing is only performed on the free end side of the nail T, such as illustrated on the left side of FIG. 6B, the nail design does not run into the unsuitable drawing area A1, as illustrated on the right side of FIG. 6B. In such a case, the design determination portion 815 determines that this nail design is suitable to be drawn on the nail T.

In contrast, for example, when fitting an image of a nail design, in which a color and a pattern are drawn on the entirety of the nail T, such as illustrated on the left side of FIG. 6C, the nail design runs into the unsuitable drawing area A1, as illustrated on the right side of FIG. 6C. In such a case, the design determination portion 815 determines that this nail design is unsuitable to be drawn on the nail T.

The drawing data generation portion 816 generates drawing data for the drawing to be performed by the drawing head 43 on the nail T of the print finger U1 on the basis of the nail information detected by the nail shape detection portion 813. Specifically, the drawing data generation portion 816 performs calibration processing, such as enlarging, reducing, and cropping, to fit the image created from the image data of the nail design to the shape of the nail T, on the basis of the shape of the nail T (the outline of the nail T) and the like detected by the nail shape detection portion 813.

Additionally, the drawing data generation portion 816 functions as an image data correction portion that performs appropriate curvature correction on the image data of the nail design specified to be drawn on the nail T, in accordance with the curvature of the nail T detected by the nail shape detection portion 813.

As a result, drawing data for the nail design to be drawn by the pen 41 or the ink jet drawing portion 71 is generated.

The drawing control portion 817 is configured to output control signals to the drawing unit 40 on the basis of the drawing data generated by the drawing data generation portion 816, and control the X-direction movement motor 46, the Y-direction movement motor 48, and the pen vertical motor 426 and the ink jet drawing portion 71 of the drawing unit 40, and the like so as to perform a drawing corresponding to the drawing data on the nail T.

Specifically, when the pen 41 is not drawing, the drawing control portion 817 controls the pen vertical motor 426 to maintain a state where the retaining protrusion 424 is not pressed down by the plate spring 429; and, when the pen 41 is drawing, the drawing control portion 817 causes the pen vertical motor 426 to operate and controls the operation of the pen vertical motor 426 so that the retaining protrusion 424 is pressed down by the plate spring 429 and the tip portion (the pen tip 413) of the pen 41 comes into contact with the surface of the nail T.

Note that at locations where the height of the nail T changes greatly and cannot be handled by the flexible deformation (elastic deformation) of the plate spring 429 alone, the drawing control portion 817 preferably causes the number of steps of the pen vertical motor 426 to be increased or decreased, thus adjusting the pen pressure of the pen 41 so that the pen pressure becomes roughly constant.

The display control portion 818 is configured to control the display unit 26 to cause the display unit 26 to display various display screens. In the present embodiment, examples of the various display screens the display control portion 818 is configured to display on the display unit 26 include nail design selection screens and thumbnail images for confirming designs, nail images acquired by imaging the print finger U1, various command screens, operation screens, and the like.

Additionally, in the present embodiment, as described previously, the display control portion 818 is configured to cause the display unit 26 to function as a notification means for informing a user of the suitability of drawing a nail design on the nail T on the basis of the determination result of the design determination portion 815. For example, in cases where the design determination portion 815 determines that the nail design selected by the user is unsuitable for drawing on the nail T, the display control portion 818 causes the display unit 26 to display that determination result.

Additionally, the display control portion 818 is configured to cause the display unit 26 to function as design presentation means for displaying a design presentation screen on which nail designs suitable for drawing are presented to the user, on the basis of the determination result by the design determination portion 815.

Figure 7:
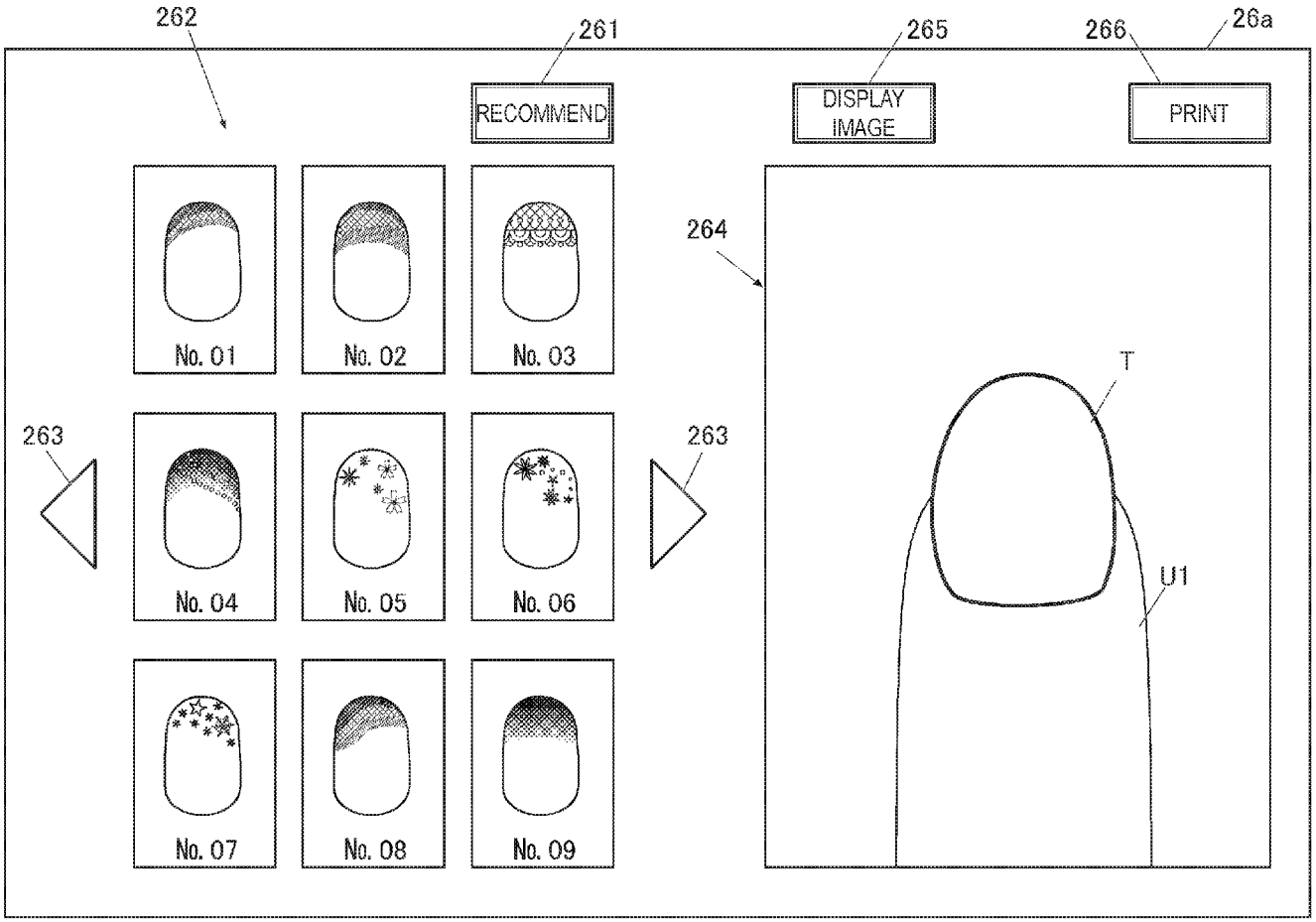
FIG. 7 is a display screen example illustrating an example of a nail design presentation screen of a display unit.

FIG. 7 illustrates an example of a design presentation screen 26*a*.

For example, as illustrated in FIG. 7, a recommend button 261 is provided on a design selection screen from which a user selects a nail design. When the user operates the recommend button 261 on the display screen, the design presentation screen 26*a* provided with a recommendation list screen 262 such as that illustrated on the left side of FIG. 7 is displayed. A list of nail designs determined to be suitable for drawing on the nail T of the user by the design determination portion 815 is displayed on the recommendation list screen 262.

For example, in cases where the root side of the nail T is the unsuitable drawing area A1 as illustrated in FIG. 6A, nail designs in which the drawing target region is only the free end side of the nail T, such as a French manicure nail, are preferentially displayed on the recommendation list screen 262, as illustrated in FIG. 7.

Note that in cases where all of the nail designs cannot be displayed on one screen, it is preferable that the recommendation list screen 262 includes page turn buttons 263 for displaying the previous page and the next page.

Additionally, the display control portion 818 is configured to cause the display unit 26 to function as an expected finish presentation means that present an expected finish of a case where the nail design selected by the user is drawn on the nail T, on the basis of the determination result of the design determination portion 815.

For example, as illustrated on the right side of FIG. 7, the display control portion 818 causes the display unit 26 to display a nail image display field 264 that displays the nail T of the user, which is the drawing object. A display image button 265 is provided that causes a drawing image to be displayed. The display control portion 818 is configured to superimpose the drawing image, of a case where the nail design selected by the user is drawn, on the nail T displayed in the nail image display field 264 when the display image button 265 is operated, and present the expected finish to the user.

For example, in a case where the user selects a nail design in which a color and a pattern are drawn over the entirety of the nail T such as that illustrated in FIG. 6C and operates the display image button 265, an expected finish in which the color and pattern is blurred or faded in the portion that runs into the unsuitable drawing area A1 on the root side of the nail T is superimposed on the image of the nail T and displayed.

The display unit 26 is provided with a start printing button 266 and, when a user operates this button, the drawing of the selected nail design starts.

Note that a configuration is provided in which even with nail designs that the design determination portion 815 determines to be unsuitable for drawing on the nail T of the user, if the user selects such a nail design and operates the start printing button 266, the drawing of the nail design will start.

Figure 8:
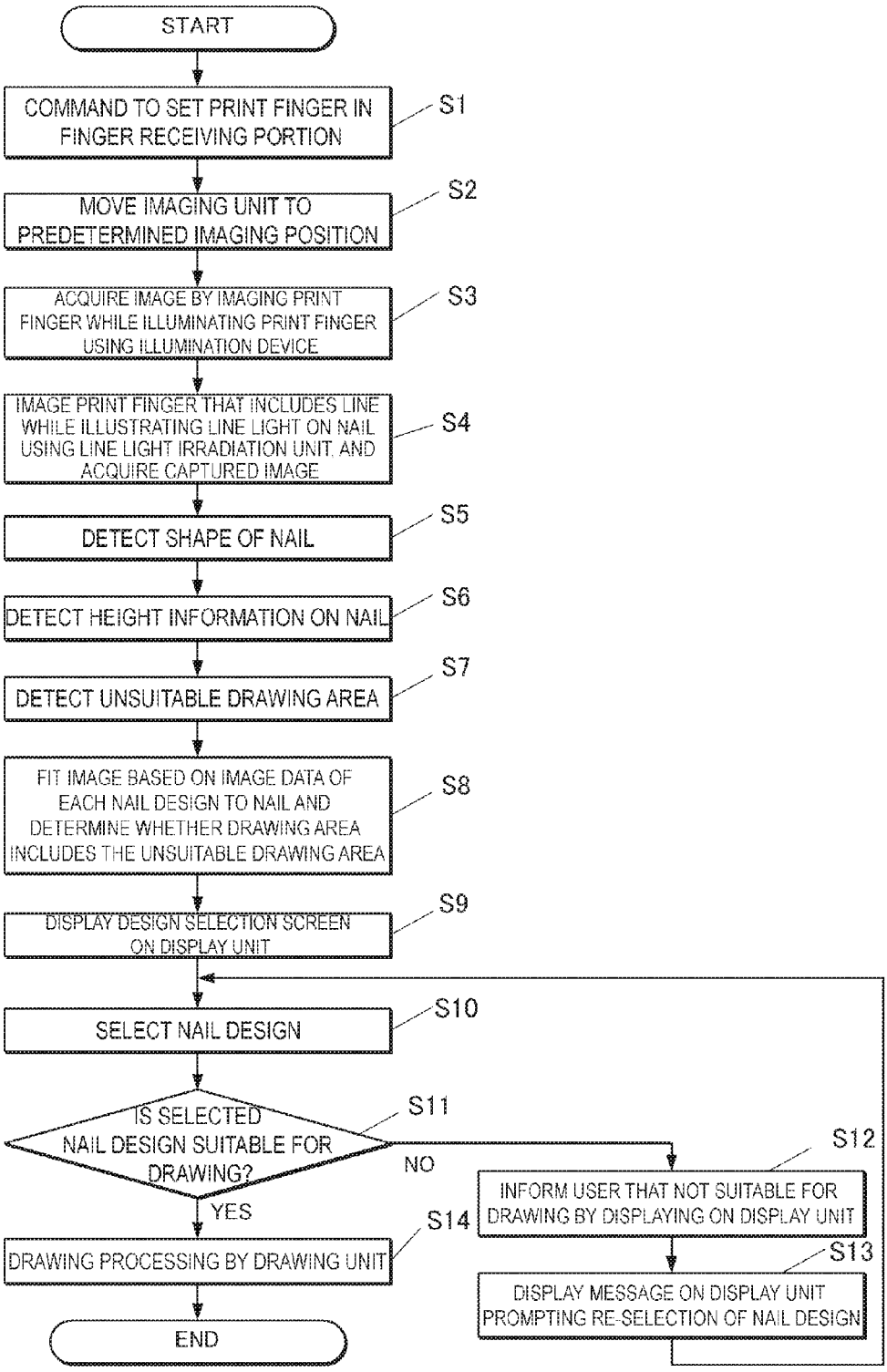
FIG. 8 is a flowchart showing design determination processing and drawing processing of the drawing apparatus according to the embodiment of the present invention.

Next, design determination processing and drawing processing by the nail printing apparatus 1 according to the present embodiment is described while referencing FIG. 8.

In cases where performing drawing using the nail printing apparatus 1, a user first operates a power switch to turn on the control device 80.

Next, as shown in FIG. 8, the display control portion 818 causes the display unit 26 to display a command screen prompting that the print finger U1 be set in the finger receiving portion 31 (step S1). The user operates a draw switch (not illustrated) of the operation unit 25 after inserting the print finger U1 into the finger receiving portion 31, inserting the non-print fingers U2 into the finger clearing portion 32, and securing the print finger U1 in the finger receiving portion 31.

Upon input of a command from the draw switch and before starting the drawing operation, first, the drawing control portion 817 controls the head movement portion 49 and causes the imaging unit 50 to move to a predetermined imaging position (step S2). For example, in order to image from directly above the nail T, the head movement portion 49 is controlled so as to move the imaging unit 50 directly above the nail T.

Then, the imaging control portion 811 controls the imaging unit 50 to cause the image capturing device 51 to image the print finger U1 while illuminating the print finger U1 using the illumination device 52. As a result, the imaging control portion 811 acquires a captured image (nail image) of the nail T of the print finger U1 that has been inserted into the finger receiving portion 31 (step S3).

Additionally, the light source control portion 812 controls the line light irradiation unit 55 to irradiate the nail T with line light and, at the same time, the imaging control portion 811 controls the imaging unit 50 to cause the image capturing device 51 to image the print finger U1. As a result, the imaging control portion 811 acquires a captured image (line image) of the nail T of the print finger U1 that includes an image of the line La (step S4). Note that it is preferable that the imaging be performed multiple times while changing the illumination position of the line light. Additionally, the captured images may by a plurality of still images acquired by imaging multiple times, or may be a continuous moving picture.

Upon acquisition of the captured images (the nail images), the nail shape detection portion 813 detects the shape (the outline) of the nail T on the basis of the nail images (the captured images) (step S5). Additionally, the nail shape detection portion 813 detects the position of X-Y coordinates of the nail T, the curvature of the nail T, and other nail information on the basis of the nail images (the captured images).

Furthermore, the nail height detection portion 814 detects the height information on the nail T on the basis of the captured images (the line images) (step S6).

Moreover, the design determination portion 815 creates the height map on the basis of the height information on the nail T detected by the nail height detection portion 814, and detects the portion thereof with a height lower than the predetermined value as the unsuitable drawing area A1 (step S7).

Additionally, the design determination portion 815 performs fitting processing in which images based on the image data of each nail design stored in the nail design memory region 823 are calibrated to the shape (the outline) of the nail T detected by the nail shape detection portion 813. As a result of this fitting processing, the design determination portion 815 determines whether or not a portion or an entirety of the nail design is located in the unsuitable drawing area A1, which extends beyond the drawable range on the surface of the nail T in the height direction of the drawing unit 40 (step S8), and saves the determination result in the memory unit 82.

The display control portion 818 causes the design selection screen to be displayed on the display unit 26 (step S9), and the user operates operation buttons or the like on the operation unit 25 and selects a desired nail design from among a plurality of nail designs displayed on the design selection screen. As a result, a selection command signal is output from the operation unit 25 and the nail design intended to be drawn on the nail T is selected (step S10).

Note that upon the user operating the recommend button 261 on the design selection screen, as illustrated in FIG. 7, the design presentation screen **26*a* is displayed on display unit 26, the design presentation screen 26*a* being provided with the recommendation list screen 262 in which a list of nail designs determined to be suitable for drawing on the nail T of the user by the design determination portion 815**.

Upon selection of a nail design, the design determination portion 815 determines whether or not the selected nail design is suitable for drawing (step S11). Specifically, the design determination portion 815 references the result determined in step S8 and determines whether or not the nail design is suitable for drawing on the drawing object, namely, the nail T.

In cases where the design determination portion 815 determines that the nail design is unsuitable for drawing (step S11; NO), the display control portion 818 notifies/alerts the user by causing the display unit 26 to display that the design is unsuitable for drawing (step S12). In this case, the display control portion 818 also causes the display unit 26 to display a message or the like prompting the user to re-select a nail design (step S13).

In cases where the user receives the notification displayed on the display unit 26 and re-selects a nail design, the processing is repeated in the same manner starting from step S10.

On the other hand, in cases where the design determination portion 815 determines that the nail design is suitable for drawing (step S11; YES), drawing processing for drawing the nail design selected by the user on the nail T is performed by the drawing unit 40 (step S14). Specifically, the drawing data of the nail design is generated by the drawing data generation portion 816, the drawing control portion 817 outputs the drawing data to the drawing unit 40, and the drawing is performed on the nail T by the pen 41 or the ink jet drawing portion 71 while the head movement portion 49 is operated to cause the drawing head 43 to move appropriately.

As described above, according to the present embodiment, the height of the nail T is detected from the captured images of the nail T, and the suitability of drawing the nail design on the surface of the nail T is determined on the basis of the drawable range based on the detection result of the height of the nail T. As such, in cases where there are portions where the height is low such that drawing on the nail T by the pen 41 or the ink jet drawing portion 71 of the drawing unit 40 cannot be performed, a determination can be made in advance that the finish of the nail print, if drawn as-is, will be poor, and the quality of the finish of the nail design can be preserved.

Additionally, in the present embodiment, fitting processing is performed in which the images of the nail designs are calibrated to the shape of the nail T. As a result of the fitting processing, it is determined that a nail design is unsuitable for drawing on the surface of the nail T when all or a portion of the nail design is located in a portion that extends beyond the drawable range on the surface of the nail T in the height direction of the drawing unit 40. Thus, the suitability is determined while taking into consideration whether or not the drawing will be affected by the portions of the nail T where the height is low in a case where the nail design is actually drawn on the drawing object, namely the nail T.

Additionally, in the present embodiment, the determination result by the design determination portion 815 is displayed on the display unit 26 and, thus, the display unit 26 is caused to function as notification means for informing of the suitability of drawing the nail design. As such, a user can know prior to performing the drawing processing whether or not the selected nail design can be drawn with a good finish on the nail T and mistakes in nail printing can be avoided.

Additionally, in the present embodiment, the display unit 26 is caused to display the design presentation screen 26*a* for presenting nail designs suitable for drawing, on the basis of the determination result by the design determination portion 815. Thus, the display unit 26 is caused to function as design presentation means. As such, a user can be made aware of the nail designs that can be drawn neatly on the nail T, and can appropriately select nail designs that can be drawn with a good finish.

Additionally, in the present embodiment, the display unit 26 is caused to display an expected finish presentation screen for presenting an expected finish of a case where a nail design is drawn, on the basis of the determination result by the design determination portion 815. Thus, the display unit 26 is caused to function as expected finish presentation means. As such, even if a nail design is determined by the design determination portion 815 to be unsuitable for drawing on the nail T, a user can assess the degree to which the finish quality will decline and determine whether or not to perform the drawing processing. For example, in cases of performing drawing by the ink jet drawing portion 71, even in cases where the nail design runs into the unsuitable drawing area A1, depending on the pattern, there are cases where a decline in the finish quality will be of little concern due to the fact that the finish quality of the drawing declines gradually along with declines in the height of the nail T. In such a case, completely denying the drawing may be contrary to the intent of the user and the user can determine whether or not to draw after viewing the expected finish. Due to this, situations can be avoided where the drawing of the nail design desired by the user is unnecessarily obstructed.

The embodiment described above is for the purpose of elucidating the present invention and is not to be construed as limiting the present invention. The invention can of course be altered and improved without departing from the gist thereof.

For example, in the present embodiment, the design determination portion 815 determines whether or not the nail designs are suitable for drawing by performing the fitting processing on each of the nail designs, but the technique for determining whether or not the nail designs are suitable for drawing is not limited thereto. For example, a technique is possible in which the image data of the nail designs is divided in advance into levels such as French manicure nails for which drawing is performed only on the free end portion of the nail T, designs for which a solid color is drawn on the entirety of the nail, designs for which colors and patterns are drawn on the entirety of the nail T, and the like. Then, depending on the unsuitable drawing area A1, only the nail designs categorized as French manicure nails may be determined to be suitable for drawing.

Additionally, in the present embodiment, the design determination portion 815 determines whether or not the nail designs are suitable for drawing by performing the fitting processing on each of the nail designs in advance, but the timing at which the determination is performed is not limited to this example.

For example, the determination as to whether or not a nail design is suitable for drawing, made by performing the fitting processing on the selected nail design, may be performed at the point when the user selects a nail design. For example, in cases where there are many types of nail designs stored in the memory unit 82, instead of performing the determination processing for all of the nail designs in advance, processing speed can be improved and processing can be efficiently carried out by performing the determination processing on only the selected nail design, as described above.

Additionally, in the present embodiment, an example has been given of a case in which all of the nail designs are caused to be displayed on the design selection screen displayed on the display unit 26 and, upon operation of the recommend button 261, the nail designs are narrowed down and only those that are determined to be suitable for drawing are displayed. However, the nail designs displayed on the display unit 26 may be narrowed down from the start to those determined to be suitable for drawing. In this case, the hassle of a user having to re-select after because the nail design is not suitable for drawing can be eliminated.

Additionally, the technique by which the design determination portion 815 determines whether or not each nail design is suitable for drawing is not limited to techniques that include performance of the fitting processing. For example, a predetermined threshold corresponding to the height of the nail T may be provided and nail designs that are greater than or equal to this threshold may be determined as being suitable for drawing.

Additionally, in the present embodiment, an example has been given of a case in which the nail T is irradiated with the line light and imaging is performed, and the height information on the nail T is obtained using the position of the line La in that captured image. However, the technique for detecting the height information on the nail T by the nail height detection portion is not limited thereto and various techniques can be used.

Additionally, in the present embodiment, an example has been given of a case in which the line light irradiation unit 55 that emits the line light is configured to be movable together with the drawing head. However, a separate mechanism for moving the line light irradiation unit 55 alone may be provided.

Additionally, in the present embodiment, a configuration has been described in which the drawing head 43 of the nail printing apparatus (the drawing apparatus) 1 is provided with the pen holder 42 that holds the pen 41 for drawing and also the ink jet drawing portion 71. However, the drawing apparatus may have a configuration in which the ink jet drawing portion 71 is not provided and the drawing is performed by only the pen 41.

In the present embodiment, an example has been given of a case in which the drawing head 43 is provided with one pen holder 42. However, the number of pen holders 42 provided in the drawing head 43 is not limited to one. For example, a configuration is possible in which two or more pen holders 42 are provided and two or more pens 41 for drawing are held.

In the present embodiment, an example has been given of a case in which a user manually replaces the pen 41 held by the pen holder 42 as necessary. However, a configuration is possible in which a waiting space is provided where the pens 41 stand by in a home area 60 or the like, and the required pen 41 is automatically acquired from the waiting space and inserted into the pen holder 42 by a pen replacing mechanism (not illustrated).

In the present embodiment, an example has been given of a case where the imaging device 51 and the illumination device 52 are mounted on the drawing head 43. However, the location where the imaging device 51 and the illumination device 52 are provided is not limited thereto.

For example, a mechanism for moving the imaging unit 50 may be provided separately from the mechanism for moving the drawing head 43.

In the present embodiment, an example has been given of the nail printing apparatus 1 in which fingers are inserted into the apparatus one finger at a time and drawing is performed sequentially. However, a configuration is possible in which consecutive drawing can be performed on a plurality of fingers, without the need to insert and remove each finger.

The present invention has been described using specific embodiments, but it goes without saying that the technical scope of the present invention is not limited to these embodiments. The embodiments described above are not to be construed as limiting the scope of the present invention and include the scope of the invention recited in the claims and equivalents.

It is obvious to a person skilled in the art that various modifications and improvements can be made to the specific embodiments described above, and it is obvious from the recitations of the claims that aspects including such modification and improvements are encompassed within the technical scope of the present invention.

The invention claimed is:

1. A drawing apparatus comprising:

an insertion portion into which a finger or toe having a nail is inserted, the insertion portion having a reference plane provided therein;

a nail height detection portion that detects a distribution of height from the reference plane within a surface of the nail, on the basis of an image obtained by imaging the nail;

a drawing unit that draws a nail design on a drawable area in the nail, the drawable area being defined on the basis of a distance between the nail and the drawing unit; and a design determination portion that determines a suitability of drawing the nail design on the surface of the nail by the drawing unit, on the basis of the drawable area based on the distribution by the nail height detection portion.

2. The drawing apparatus according to claim 1, wherein the nail design determined by the design determination portion to be suitable for drawing is drawn on the surface of the nail by the drawing unit.

3. The drawing apparatus according to claim 1, wherein the nail height detection portion detects the distribution of height from the reference plane within the surface of the nail, on the basis of the image obtained by illuminating line light from a line light irradiation unit toward the surface of the nail at an angle where the line light diagonally illuminates the reference plane, and imaging the nail and a line formed on the nail.

4. The drawing apparatus according to claim 3, wherein the nail height detection portion detects the distribution of height from the reference plane within the surface of the nail, on the basis of two or more images obtained by changing a position where the line light illuminates a plurality of times along a length of the nail and imaging.

5. The drawing apparatus according to claim 1, further comprising a nail shape detection portion that detects a shape of the nail on the basis of the image; wherein the design determination portion performs fitting processing in which an image of the nail design is calibrated to the shape of the nail detected by the nail shape detection portion; and the design determination portion determines that the nail design is unsuitable for drawing on the surface of the nail when a result of the fitting processing indicates all or a portion of the nail design is located in a portion that extends beyond the drawable area on the surface of the nail of the drawing unit.

6. The drawing apparatus according to claim 1, further comprising notification means for informing of the suitability of drawing the nail design, on the basis of the determination result by the design determination portion.

7. The drawing apparatus according to claim 1, further comprising design presentation means for presenting the nail design suitable for drawing, on the basis of the determination result by the design determination portion.

8. The drawing apparatus according to claim 1, further comprising expected finish presentation means for presenting an expected finish of a case in which the nail design has been drawn, on the basis of a determination result by the design determination portion.

9. A drawing method for a drawing apparatus, the drawing apparatus comprising:

an insertion portion into which a finger or toe having a nail is inserted, the insertion portion having a reference plane provided therein; and a drawing unit that draws a nail design on a drawable area in the nail, the drawable area being defined on the basis of a distance between the nail and the drawing unit;

the drawing method comprising:

detecting a distribution of height from the reference plane within a surface of the nail, on the basis of an image obtained by imaging the nail of the finger or toe; and determining a suitability of drawing the nail design on the surface of the nail by the drawing unit, on the basis of the drawable area based on the distribution.

10. The drawing method for a drawing apparatus according to claim 9, wherein the nail design determined to be suitable for drawing is drawn on the surface of the nail by the drawing unit.

11. The drawing method for a drawing apparatus according to claim 9, further comprising:

detecting a shape of the nail on the basis of the image;

performing fitting processing in which an image of the nail design is calibrated to the shape of the detected nail; and determining that the nail design is unsuitable for drawing on the surface of the nail when a result of the fitting processing indicates all or a portion of the nail design is located in a portion that extends beyond the drawable area on the surface of the nail of the drawing unit.

12. The drawing method for a drawing apparatus according to claim 9, further comprising informing of the suitability of drawing the nail design, on the basis of the determination result.

13. The drawing method for a drawing apparatus according to claim 9, wherein the detecting of the distribution of height is detected from the reference plane within the surface of the nail, on the basis of at least one image obtained by illuminating line light from a line light irradiation unit toward the surface of the nail at an angle where the line light diagonally illuminates the reference plane, and imaging the nail and a line formed on the nail.

14. The drawing method for a drawing apparatus according to claim 13, wherein the detecting of the distribution of height is detected from the reference plane within the surface of the nail, on the basis of two or more images obtained by changing a position where the line light illuminates a plurality of times along a length of the nail and imaging.

15. The drawing method for a drawing apparatus according to claim 9, further comprising presenting the nail design suitable for drawing, on the basis of the determination result.

16. The drawing method for a drawing apparatus according to claim 9, further comprising presenting an expected finish of a case in which the nail design has been drawn, on the basis of the determination result.

* * * * *